US005603118A

United States Patent [19]

Solomon

[11] Patent Number: 5,603,118

[45] Date of Patent: Feb. 18, 1997

[54] INFLATABLE PADDED GLOVE

[76] Inventor: Todd Solomon, 1458 Maryland Ave., Havertown, Pa. 19083

[21] Appl. No.: 452,839

[22] Filed: May 30, 1995

[51] Int. Cl.[6] ..... A41D 19/00

[52] U.S. Cl. ..... 2/20; 2/160; 2/161.1; 2/163; 2/DIG. 3

[58] Field of Search ..... 2/DIG. 3, 159, 2/160, 161.1, 16, 161.2, 161.6, 20, 161.3, 161.8, 163; 36/29

[56] References Cited

U.S. PATENT DOCUMENTS 4,094,014 6/1978 Schroeder ..... 2/161.8
5,113,599 5/1992 Cohen et al. ..... 36/29
5,214,799 6/1993 Fabry ..... 2/20
5,257,418 11/1993 Jaskiewicz ..... 2/DIG. 3

FOREIGN PATENT DOCUMENTS 2536180 2/1977 Germany ..... 2/161.8

*Primary Examiner*—C. D. Crowder
*Assistant Examiner*—Larry D. Worrell, Jr.

[57] ABSTRACT

A glove for padding a human hand. The inventive device includes a glove member having open truncated finger tubes and a thumb tube extending therefrom. Pneumatic chambers are coupled to a palm web of the glove and can be individually inflated to a desired pressure to selectively pad the glove.

4 Claims, 3 Drawing Sheets

INFLATABLE PADDED GLOVE

BACKGROUND OF THE INVENTION

1. Field of the Invention

The present invention relates to hand covering structures and more particularly pertains to an inflatable padded glove for padding a human hand.

2. Description of the Prior Art

The use of hand covering structures is known in the prior art. More specifically, hand covering structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art hand covering structures include U.S. Pat. No. 5,330,249; U.S. Pat. No. 5,257,418; U.S. Pat. No. 5,218,719; U.S. Pat. No. 4,864,659; and U.S. Pat. No. 4,411,024.

While these devices fulfill their respective, particular objectives and requirements, the aforementioned patents do not disclose an inflatable padded glove for padding a human hand which includes a glove member having open truncated finger tubes and a thumb tube extending therefrom, and pneumatic chambers coupled to a palm web of the glove which can be individually inflated to a desired pressure to selectively pad the glove.

In these respects, the inflatable padded glove according to the present invention substantially departs from the conventional concepts and designs of the prior art, and in so doing provides an apparatus primarily developed for the purpose of padding a human hand.

SUMMARY OF THE INVENTION

In view of the foregoing disadvantages inherent in the known types of hand covering structures now present in the prior art, the present invention provides a new inflatable padded glove construction wherein the same can be utilized for padding a human hand. As such, the general purpose of the present invention, which will be described subsequently in greater detail, is to provide a new inflatable padded glove apparatus and method which has many of the advantages of the hand covering structures mentioned heretofore and many novel features that result in an inflatable padded glove which is not anticipated, rendered obvious, suggested, or even implied by any of the prior art hand covering structures, either alone or in any combination thereof.

To attain this, the present invention generally comprises a glove for padding a human hand. The inventive device includes a glove member having open truncated finger tubes and a thumb tube extending therefrom. Pneumatic chambers are coupled to a palm web of the glove and can be individually inflated to a desired pressure to selectively pad the glove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable padded glove apparatus and method which has many of the advantages of the hand covering structures mentioned heretofore and many novel features that result in an inflatable padded glove which is not anticipated, rendered obvious, suggested, or even implied by any of the prior art hand covering structures, either alone or in any combination thereof.

It is another object of the present invention to provide a new inflatable padded glove which may be easily and efficiently manufactured and marketed.

It is a further object of the present invention to provide a new inflatable padded glove which is of a durable and reliable construction.

An even further object of the present invention is to provide a new inflatable padded glove which is susceptible of a low cost of manufacture with regard to both materials and labor, and which accordingly is then susceptible of low prices of sale to the consuming public, thereby making such inflatable padded gloves economically available to the buying public.

Still yet another object of the present invention is to provide a new inflatable padded glove which provides in the apparatuses and methods of the prior art some of the advantages thereof, while simultaneously overcoming some of the disadvantages normally associated therewith.

Still another object of the present invention is to provide a new inflatable padded glove for padding a human hand during weight lifting exercises or the like.

Yet another object of the present invention is to provide a new inflatable padded glove which includes a glove member having open truncated finger tubes and a thumb tube extending therefrom, and pneumatic chambers coupled to a palm web of the glove which can be individually inflated to a desired pressure to selectively pad the glove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
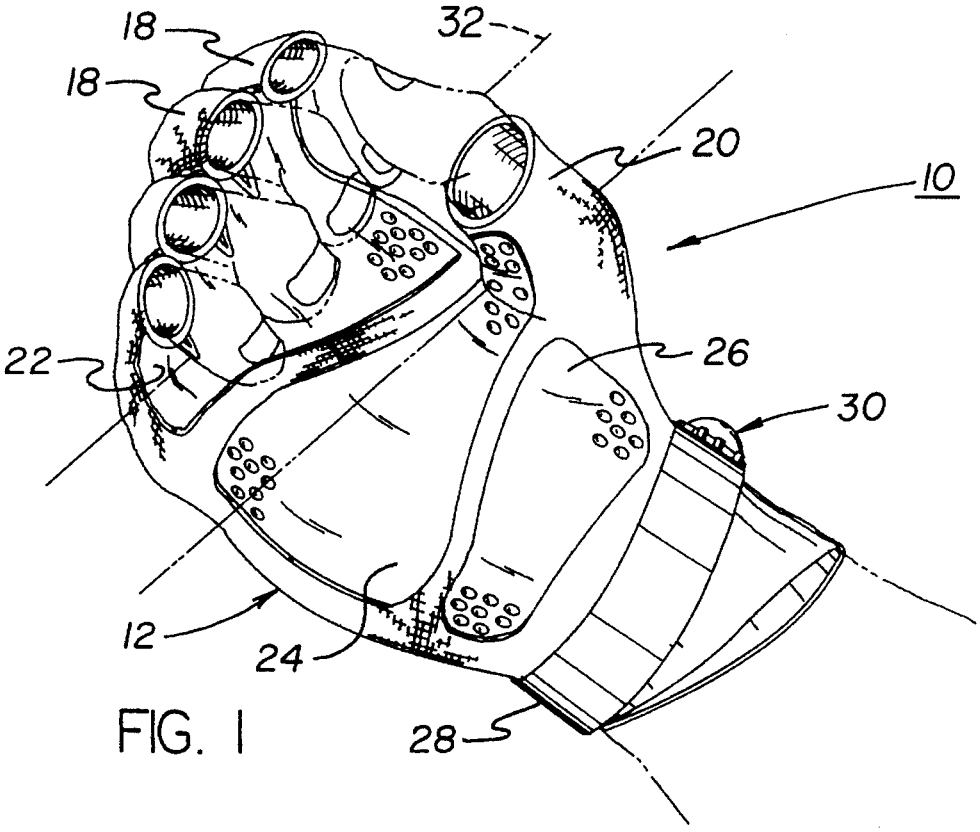
FIG. 1 is an isometric illustration of an inflatable padded glove according to the present invention in use.

With reference now to the drawings, and in particular to FIGS. 1–8 thereof, a new inflatable padded glove embodying the principles and concepts of the present invention and generally designated by the reference numeral 10 will be described.

More specifically, it will be noted that the inflatable padded glove 10 comprises a glove member 12 for positioning over a human hand as shown in FIG. 1 of the drawings. The glove member 12 is constructed of a palm web 14 coextensively positionable over a palm surface of the human hand, and a back web 16 spaced from and coupled to the palm web 14 so as to coextensively cover a back of the human hand. The palm web 14 cooperates with the back web 16 so as to define a plurality of finger tubes 18 and a thumb tube 20 extending therefrom for individually receiving respective fingers and a thumb of the human hand when positioned within the glove member 12. Preferably, the finger tubes 18 and the thumb tube 20 are truncated and open at the free distal ends thereof such that the human fingers and thumb can project therethrough and beyond the tubes 18 and 20 as shown in FIG. 1 of the drawings. A first pneumatic chamber 22 is secured to the palm web 14 of the glove member 12 proximal to the finger tubes 18. A second pneumatic chamber 24 extends transversely across the palm web 14 proximal to the thumb tube 20. A third pneumatic chamber 26 extends along the palm web 14 and is spaced from the first pneumatic chamber 22 such that the second pneumatic chamber 24 resides between the first and third pneumatic chambers. A wrist strap 28 is coupled to the palm web 14 and the back web 16 and configured for circumferential positioning about a wrist of an individual wearing the device 10. A pump means 30 is mounted to the wrist strap 28 and positionable in selective fluid communication with an individual one of the pneumatic chambers 22–26 for effecting pressurization of the respective chamber. By this structure, an individual utilizing the device can selectively and individually pressurize the pneumatic chambers 22–26 to a desired pressure to pad the hand during grasping of an object 32 such as the weight lifting bar illustrated in FIG. 1 of the drawings.

Figure 2:
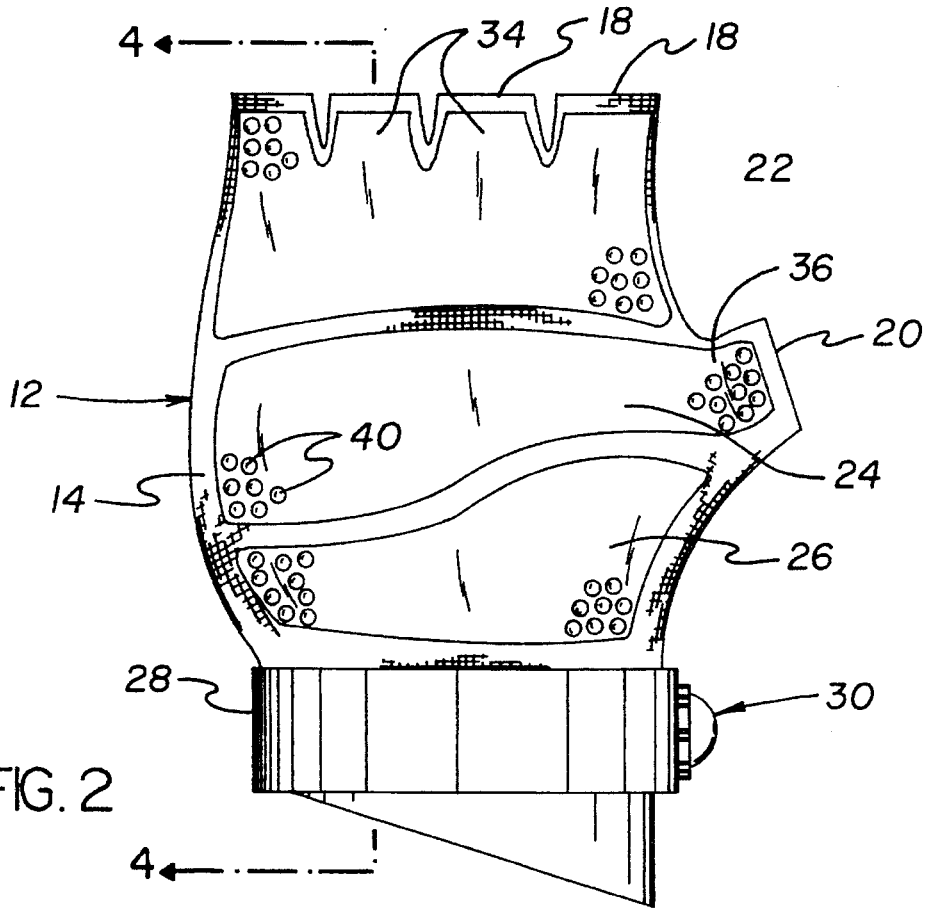
FIG. 2 is an elevation view of the invention, per se.
Figure 3:
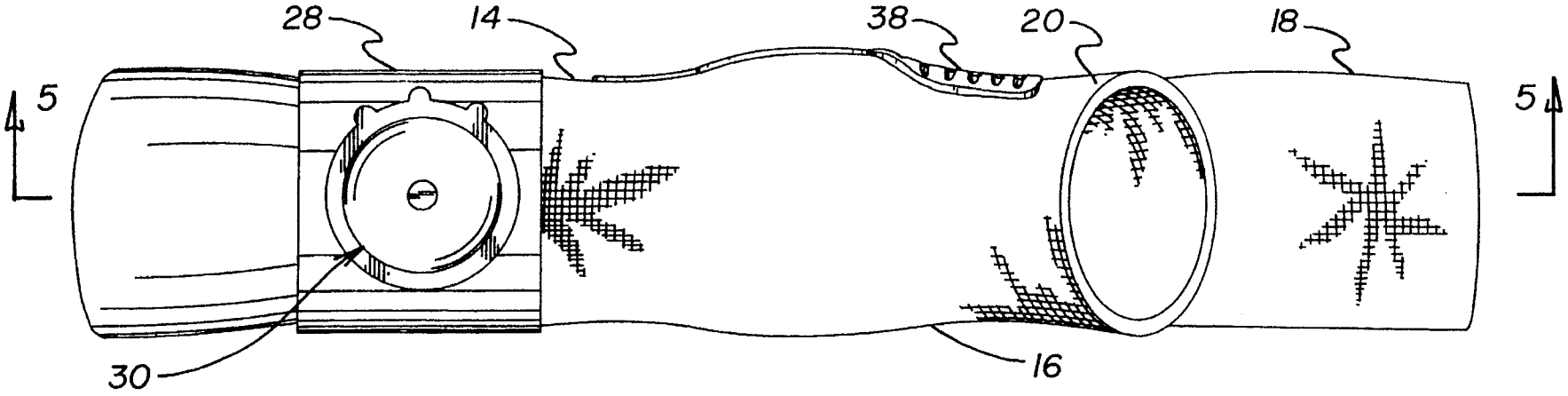
FIG. 3 is a side elevation view of the invention.
Figure 4:
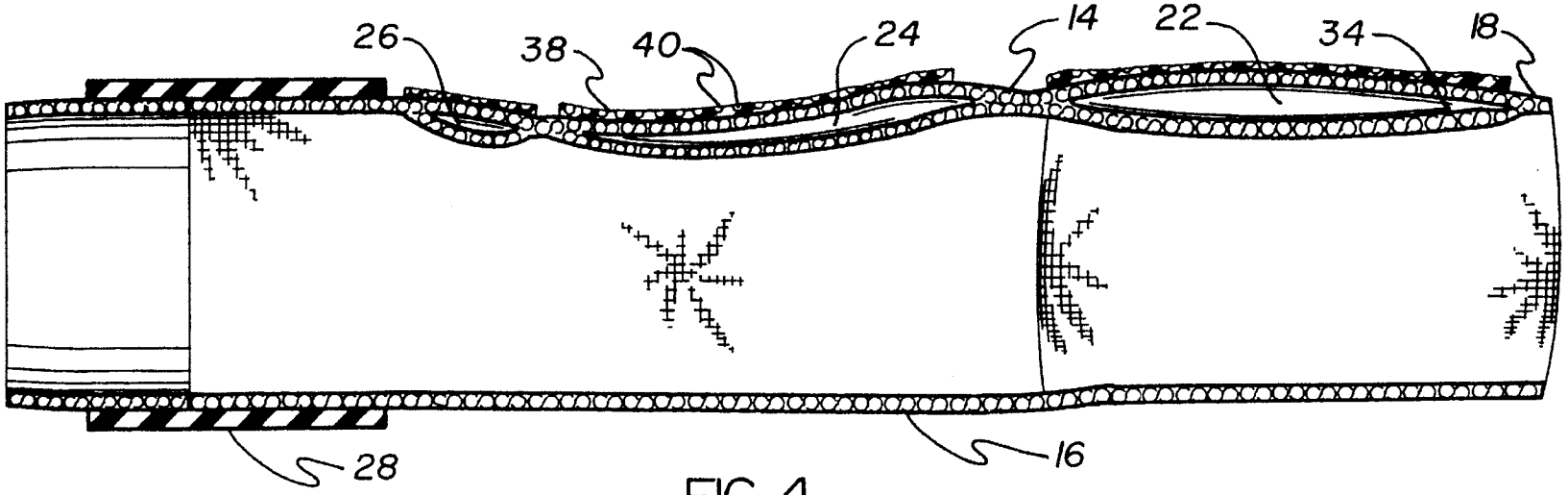
FIG. 4 is a cross-sectional view taken along line 4—4 of FIG. 2.
Figure 5:
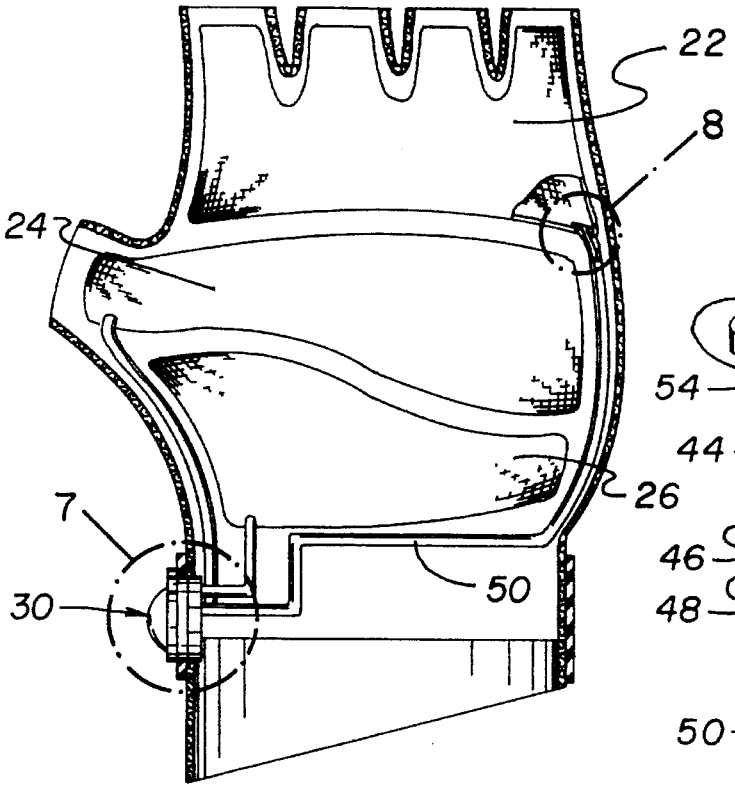
FIG. 5 is a cross-sectional view taken along line 5—5 of FIG. 3.
Figure 6:
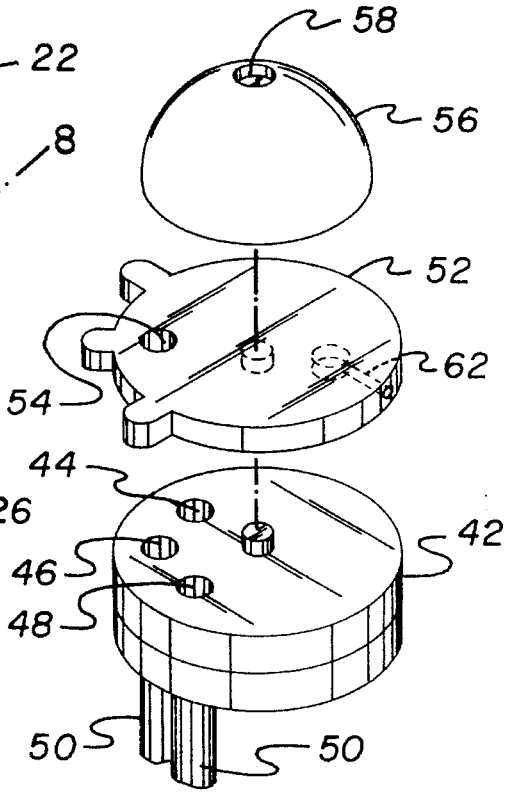
FIG. 6 is an exploded isometric illustration of a pump means comprising a portion of the present invention.
Figure 7:
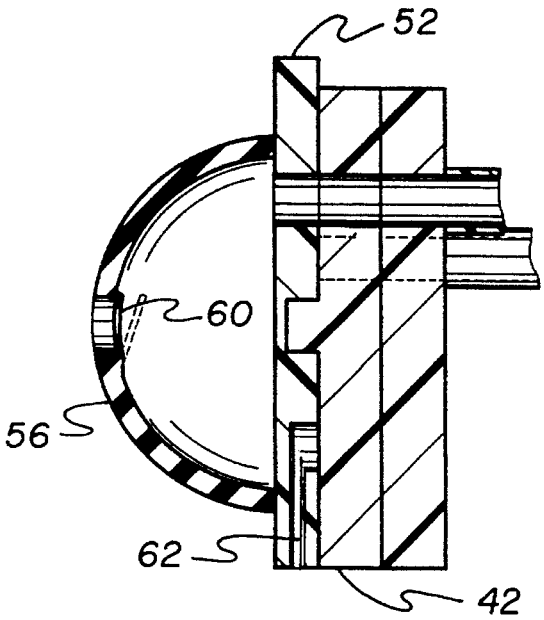
FIG. 7 is a cross-sectional view of the pump means as set forth in FIG. 5.
Figure 8:
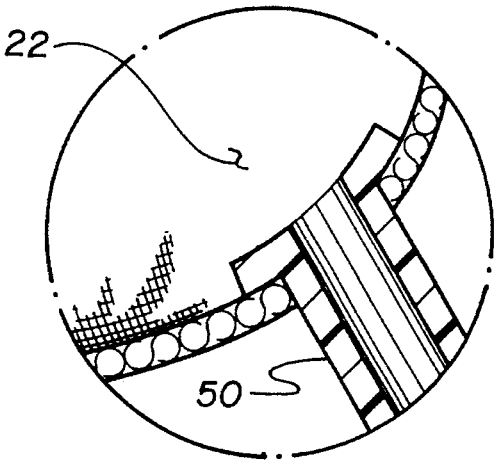
FIG. 8 is a cross-sectional view of the area set forth in FIG. 5.

As illustrated in FIGS. 2 through 4, it can be shown that the first pneumatic chamber 22 is shaped so as to define a plurality of finger tube chambers 34 each extending onto an individual one of the finger tubes 18. Similarly, the second pneumatic chamber 24 is shaped so as to define a thumb tube chamber 36 extending onto the thumb tube 20 of the glove member 12. By this structure, an individual utilizing the device 10 is afforded padding along interior portions of the fingers and thumb of the human hand in addition to the padding along the palm of the human hand provided by the major portions of the pneumatic chambers 22–26.

As shown in FIGS. 2 through 4, the present invention 10 may further comprise a plurality of gripping pads 38 secured to the palm web 14 of the glove member 12. Each of the gripping pads 38 is coextensively positioned over an individual one of the pneumatic chambers 22–26 as illustrated in FIG. 2. Preferably, the gripping pads 38 each comprise a sheet of substantially flexible material having a plurality of hemi-spherical apertures directed thereinto. The hemi-spherical apertures 40, as shown in FIGS. 2 and 4, operate as small suction cups creating a pneumatic coupling between the associated gripping pad 38 and an object 32 having a smooth surface thereon. By this structure, increased engagement between the glove 10 and an associated object is afforded through both the frictional and pneumatic engagement which can be created between the gripping pads 38 and a smooth or non-porous object 32.

Referring now to FIGS. 5 through 8, it can be shown that the pump means 30 of the present invention 10 preferably comprises a manifold 42 secured to the wrist strap 28. The manifold 42 is shaped so as to define a plurality of manifold apertures directed therethrough including a first manifold aperture 44, a second manifold aperture 46, and a third manifold aperture 48. The manifold apertures 44–48 are each positioned into fluid communication with an individual one of a plurality of conduits 50 which extend along an interior surface of the palm web 14 of the glove member 12. A valve plate 52 is rotatably mounted to the manifold 44 and includes a single valve aperture 54 directed therethrough which can be selectively aligned with one of the manifold apertures 44–48. A hemi-spherical flexible diaphragm 56 is adhesively or otherwise sealingly coupled to an upper surface of the valve plate 52 so as to cover the valve aperture 54. The hemi-spherical flexible diaphragm 56 includes a vent aperture 58 directed therethrough permitting a selective induction of atmospheric air into the diaphragm 56. A check valve 60 is mounted within the hemi-spherical diaphragm 56 and operates to selectively close the vent aperture 58 so as to permit a one-way direction of air therethrough. By this structure, an individual can selectively deform the hemi-spherical flexible diaphragm 56 to effect pneumatic compression of air within the diaphragm, whereby such air will be forced through the valve aperture 54 and a selected one of the manifold apertures 44–48 and into the respective pneumatic chamber 22–26. To facilitate a selective draining of air from one of the chambers 22–26, the valve plate 52 is further preferably shaped so as to define a drain aperture 62 extending only partially into the valve plate 52 which can be aligned with one of the manifold apertures 44–48. The drain aperture 62 projects laterally from the valve plate 52 so as to permit selective fluid communication between a selected one of the manifold apertures 44–48 and a surrounding atmosphere. By this structure, an individual can selectively deflate a desired one of the pneumatic chambers 22–26 as desired.

In use, the inflatable padded glove 10 according to the present invention can be easily utilized for padding an engagement between a human hand and an object 32 such as occurs during a weight lifting procedure or like activity. The present invention 10, because of the finger tube chambers 34 and the thumb tube chamber 36 extending from the respective pneumatic chambers 22 and 24, affords selective padding not only to the palm of the human hand, but also to interior portions of the fingers and thumb thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable padded glove comprising:

a glove member for positioning over a human hand, the glove member including a palm web coextensively positionable over a palm surface of the human hand, and a back web spaced from and coupled to the palm web so as to be coextensively positionable over a back of a human hand, the palm web cooperating with the back web so as to define a plurality of finger tubes and a thumb tube extending therefrom for individually receiving respective fingers and a thumb of a human hand when positioned within the glove member;

a plurality of independent, non-communicating pneumatic chambers secured to the palm web only of the glove member, the pneumatic chambers comprising a first pneumatic chamber secured to the palm web only of the glove member proximal to the finger tubes; a second pneumatic chamber extending transversely across and secured to the palm web proximal to the thumb tube; and a third pneumatic chamber extending along and secured to the palm web and spaced from the first pneumatic chamber such that the second pneumatic chamber resides between the first and third pneumatic chambers, said plurality of pneumatic chambers being independent one from the others;

a wrist strap being coupled to the palm web and configured for circumferential positioning about a wrist of an individual; and a pump means mounted to the wrist strap and positionable in selective fluid communication with an individual one of the pneumatic chambers for effecting pressurization of the respective chamber, the finger tubes and the thumb tube being truncated and open at free distal ends thereof such that human fingers and a thumb of a human hand can project therethrough and beyond the tubes, the first pneumatic chamber being shaped so as to define a plurality of finger tube chambers each extending onto an individual one of the finger tubes, the second pneumatic chamber being shaped so as to define a thumb tube chamber extending onto the thumb tube of the glove member;

a plurality of gripping pads secured to the palm web of the glove member, each of the gripping pads being coextensively positioned over an individual one of the pneumatic chambers.

2. An inflatable padded glove comprising:

a glove member for positioning over a human hand, the glove member including a palm web coextensively positionable over a palm surface of the human hand, and a back web spaced from and coupled to the palm web so as to be coextensively positionable over a back of a human hand, the palm web cooperating with the back web so as to define a plurality of finger tubes and a thumb tube extending therefrom for individually receiving respective fingers and a thumb of a human hand when positioned within the glove member;

a plurality of independent, non-communicating pneumatic chambers secured to the palm web only of the glove member, the pneumatic chambers comprising a first pneumatic chamber secured to the palm web only of the glove member proximal to the finger tubes; a second pneumatic chamber extending transversely across and secured to the palm web proximal to the thumb tube; and a third pneumatic chamber extending along and secured to the palm web and spaced from the first pneumatic chamber such that the second pneumatic chamber resides between the first and third pneumatic chambers, said plurality of pneumatic chambers being independent one from the others;

a wrist strap being coupled to the palm web and configured for circumferential positioning about a wrist of an individual; and a pump means mounted to the wrist strap and positionable in selective fluid communication with an individual one of the pneumatic chambers for effecting pressurization of the respective chamber, the finger tubes and the thumb tube being truncated and open at free distal ends thereof such that human fingers and a thumb of a human hand can project therethrough and beyond the tubes, the first pneumatic chamber being shaped so as to define a plurality of finger tube chambers each extending onto an individual one of the finger tubes, the second pneumatic chamber being shaped so as to define a thumb tube chamber extending onto the thumb tube of the glove member;

a plurality of gripping pads secured to the palm web of the glove member, each of the gripping pads being coextensively positioned over an individual one of the pneumatic chambers, the gripping pads each comprising a sheet of substantially flexible material having a plurality of hemi-spherical apertures directed thereinto, wherein the hemi-spherical apertures operate as small suction cups creating a pneumatic coupling between the gripping pad and an object.

3. An inflatable padded glove comprising:

a glove member for positioning over a human hand, the glove member including a palm web coextensively positionable over a palm surface of the human hand, and a back web spaced from and coupled to the palm web so as to be coextensively positionable over a back of a human hand, the palm web cooperating with the back web so as to define a plurality of finger tubes and a thumb tube extending therefrom for individually receiving respective fingers and a thumb of a human hand when positioned within the glove member;

a plurality of independent, non-communicating pneumatic chambers secured to the palm web only of the glove member, the pneumatic chambers comprising a first pneumatic chamber secured to the palm web only of the glove member proximal to the finger tubes; a second pneumatic chamber extending transversely across and secured to the palm web proximal to the thumb tube: and a third pneumatic chamber extending along and secured to the palm web and spaced from the first pneumatic chamber such that the second pneumatic chamber resides between the first and third pneumatic chambers, said plurality of pneumatic chambers being independent one from the others;

a wrist strap being coupled to the palm web and configured for circumferential positioning about a wrist of an individual; and a pump means mounted to the wrist strap and positionable in selective fluid communication with an individual one of the pneumatic chambers for effecting pressurization of the respective chamber, the pump means comprising a manifold secured to the wrist strap, the manifold being shaped so as to define a plurality of manifold apertures directed therethrough including a first manifold aperture, a second manifold aperture, and a third manifold aperture, the manifold apertures each being positioned into fluid communication with a respective individual one only of the pneumatic chambers; a valve plate rotatably mounted to the manifold and including a single valve aperture directed therethrough which can be selectively aligned with one of the manifold apertures; a hemi-spherical flexible diaphragm sealingly coupled to an upper surface of the valve plate so as to cover the valve aperture, the hemi-spherical flexible diaphragm including a vent aperture directed therethrough permitting a selective induction of atmospheric air into the diaphragm; and a check valve mounted within the hemi-spherical diaphragm.

4. The inflatable padded glove of claim 3, wherein the valve plate of the pump means further is shaped so as to define a drain aperture extending only partially into the valve plate which can be aligned with one of the manifold apertures, the drain aperture projecting laterally from the valve plate so as to permit selective fluid communication between a selected one of the manifold apertures and a surrounding atmosphere.

* * * * *